US006301948B1

(12) United States Patent
Weiland

(10) Patent No.: US 6,301,948 B1
(45) Date of Patent: Oct. 16, 2001

(54) RIVET SETTING DEVICE

(75) Inventor: Marcus Weiland, Mannheim (DE)

(73) Assignees: M. H. Honsel Beteiligungs GmbH (DE); Sartam Industries, Inc., Venice, FL (US)

( * ) Notice: Subject to any disclaimer, the term of this patent is extended or adjusted under 35 U.S.C. 154(b) by 0 days.

(21) Appl. No.: 09/442,017

(22) Filed: Nov. 17, 1999

(30) Foreign Application Priority Data

Jan. 26, 1999 (DE) ..... 199 03 020

(51) Int. Cl.[7] ..... B21J 15/32

(52) U.S. Cl. ..... 72/391.6; 29/243.525; 29/809; 29/812.5

(58) Field of Search ..... 72/391.6; 29/812.5, 29/243.523, 243.524, 243.525, 809

(56) References Cited

U.S. PATENT DOCUMENTS

| | | | | |
|---|---|---|---|---|
| 2,495,070 | * | 1/1950 | Mellodge | 29/812.5 |
| 2,753,072 | | 7/1956 | Mitchell . | |
| 3,119,507 | | 1/1964 | Burritt . | |
| 3,127,045 | | 3/1964 | Tschantz . | |
| 3,359,777 | | 12/1967 | Lee . | |
| 3,375,883 | | 4/1968 | Schadlich . | |
| 3,397,567 | | 8/1968 | Klingler . | |
| 3,410,128 | | 11/1968 | Sauter et al. . | |
| 3,955,739 | | 5/1976 | Markus et al. . | |
| 4,085,337 | | 4/1978 | Moeller . | |
| 4,418,562 | | 12/1983 | Sakai et al. . | |
| 4,541,266 | | 9/1985 | Totsu . | |
| 4,677,362 | | 6/1987 | House, II et al. . | |
| 5,056,347 | | 10/1991 | Wagner . | |
| 5,131,255 | | 7/1992 | Fushiya et al. . | |
| 5,136,873 | * | 8/1992 | Hopkins et al. | 72/391.6 |
| 5,184,497 | * | 2/1993 | Hanlon et al. | 72/391.6 |
| 5,195,354 | | 3/1993 | Yasui et al. . | |
| 5,207,085 | * | 5/1993 | Hopkins et al. | 72/391.6 |
| 5,272,811 | | 12/1993 | Armand . | |
| 5,327,639 | * | 7/1994 | Wing et al. | 29/812.5 |
| 5,473,805 | | 12/1995 | Wille . | |
| 5,544,407 | * | 8/1996 | Ohuchi et al. | 29/525.06 |
| 5,553,478 | | 9/1996 | Di Troia . | |
| 5,921,125 | | 7/1999 | Inoue et al. . | |
| 6,026,551 | | 2/2000 | Honsel et al. . | |
| 6,098,442 | * | 8/2000 | Walldorf et al. | 72/391.6 |

FOREIGN PATENT DOCUMENTS

| | | |
|---|---|---|
| 0 527414 A1 | 2/1993 | (EP) . |
| 59-37069 | 2/1984 | (JP) . |
| 61-17250 | 1/1986 | (JP) . |
| 64-40132 | 2/1989 | (JP) . |
| 05-26278 | 4/1993 | (JP) . |
| 10-15839 | 1/1998 | (JP) . |
| 6-54441 | 7/1999 | (JP) . |
| WO 96/25258 | 8/1996 | (WO) . |

* cited by examiner

*Primary Examiner*—David Jones
(74) *Attorney, Agent, or Firm*—Coudert Brothers

(57) ABSTRACT

The present invention relates to a rivet setting device comprising a rivet setting means and a drive which actuates the rivet setting means, as well as a magazine-strip pulling means which comprises a roll in operative communication with the drive. According to the invention, in order to be able to operate rivet setting devices of such a type also in a pneumatic and/or hydraulic manner, the drive comprises a pneumatic and/or hydraulic linear drive including a piston-cylinder means and a gearing is provided for translating a linear movement of the piston-cylinder means into a rotational movement of the roll at least temporarily.

16 Claims, 2 Drawing Sheets

RIVET SETTING DEVICE

BACKGROUND OF THE INVENTION

The present invention relates to a rivet setting device comprising a rivet setting means and a drive which actuates the rivet setting means, as well as a magazine-strip pulling means which comprises a roll in operative communication with the drive.

Such rivet setting devices are known from the prior art. These are battery-operated rivet setting devices for setting blind rivets. The rivet setting means performs a pulling movement and is connected via a gearing to the drive which is formed by an electric motor. The gearing converts the rotational movement of the electric motor into a linear movement of the rivet setting means. The blind rivets are arranged on the magazine strip and are supplied via a supply means to the rivet setting means. The magazine-strip pulling means is provided for winding up the magazine strip after the removal of the blind rivet and for driving the magazine strip so as to supply further blind rivets. To this end, the magazine-strip pulling means comprises a roll which winds up the empty magazine strip under tension.

So far, magazine-strip pulling means of such a type could not be used for pneumatically and/or hydraulically operated rivet setting devices.

SUMMARY OF THE INVENTION

It is therefore the object of the present invention to provide a rivet setting device including a magazine-strip pulling means, which can also be operated pneumatically and/or hydraulically.

This object is achieved according to the invention in that the drive comprises a pneumatic and/or hydraulic linear drive including a piston-cylinder means and that a gearing is provided for translating a linear movement of the piston-cylinder unit into a rotational movement of the roll at least temporarily.

Such a solution is simple, and makes it possible to provide a magazine-strip pulling means compatible with conventional rivet supply means also in hydraulically and/or pneumatically operated rivet setting devices.

In an advantageous development of the invention, a freewheel may be provided so that the linear movement of the piston-cylinder means is transmitted to the roll in one direction only. The gearing can thereby be adapted in an easy manner to the requirements of the magazine-strip pulling means. Since the piston-cylinder means performs a reciprocating linear movement, only one motional direction of the piston-cylinder means can be used on account of said freewheel for driving the roll. This is of particular importance since the magazine strip can only be wound up in one rotational direction of the roll.

Moreover, it may be of advantage when the rivet setting device comprises a mouthpiece for receiving at least one rivet and the rivet setting means comprises a pulling means, with the pulling means being adapted to be moved by the piston-cylinder means from a position closer to the mouthpiece into a position further away from the mouthpiece for performing a rivet setting operation and the pulling means being returnable after the rivet setting operation, with the piston-cylinder means being only connected back to the roll during the return movement. It is thereby possible that the magazine strip is only wound up during the return stroke and not during the rivet setting operation.

Moreover, in an advantageous development, there may be provided a blocking means which inhibits a rotation of the roll at least during the rivet setting operation. In such a case, an unintended rotation of the roll during the rivet setting operation can also be prevented.

Moreover, it may be of advantage when the roll is designed as a winding roll for winding up a magazine strip. In such a case, the magazine strip is not only drivable by the roll, but can also be wound up at the same time and stored for re-use.

In an advantageous development of the invention, the gearing may comprise a rack gear including a rack which is provided on the piston-cylinder means and/or the pulling means and in which a gear which is connected to the roll is meshing at least indirectly. A particularly simple gearing can thereby be realized.

To achieve a particularly compact structure, the piston-cylinder means may be arranged between the rivet setting means and the gearing.

Moreover, the rivet setting device can be designed in a particularly compact manner if the piston-cylinder means comprises a continuous piston rod. Said piston rod can then be connected to the rivet setting means on the one hand and to the gearing on the other hand.

It may be of advantage when the piston rod is designed as a tube for passing torn-off rivet mandrels therethrough. In such a case, the rivet mandrels which have been torn off during the rivet setting operation can be discharged from the rivet setting means through the piston rod, which is designed as a tube, and out of the housing of the rivet setting device.

To this end, it may turn out to be of advantage when the piston rod terminates in a rivet-mandrel collecting container. This can also yield a more compact design of the rivet setting device. Moreover, stray rivet mandrels are avoided.

Moreover, it may turn out to be of advantage when the gearing is arranged between the rivet-mandrel collecting container and the piston-cylinder means. As a result, the rivet setting device can also be made more compact.

In an advantageous development of the invention, the piston of the piston-cylinder means may be movable in the pulling direction of the pulling means of the rivet setting means for performing a rivet setting operation, with the piston being movable from an initial position arranged closer to the mouthpiece into a position further away from the mouthpiece for performing the rivet setting operation. Such a design may also simplify the structure of the rivet setting device.

Moreover, it may also turn out to be of advantage when the piston-cylinder means is biased by a spring means into the initial position. A particularly simple drive can thereby be realized, with the piston of the piston-cylinder means being also returnable by the spring means.

It may also be of advantage when the spring means comprises at least one pressure spring which is arranged in the cylinder of the piston-cylinder means and is supported between an inner cylinder wall at the front side and the piston. A particularly compact and simple design of the rivet setting device can also be realized thereby.

A further simplification of the design of the rivet setting device can be achieved when the rack is made integral with the piston rod. The number of the necessary components can further be reduced thereby.

It may turn out to be of advantage when there is provided a second rack which is opposite to the first rack and arranged on the piston rod and preferably made integral therewith and in which a second guide gear which is rotatably supported within the housing is meshing. A precise support of the piston rod between the two gears can thereby be realized.

It may also turn out to be of advantage when the roll is supported by a roll shaft which projects into the housing and is rotatably supported within the housing and when the gear which is connected to the roll is connected to the roll shaft within the housing. A particularly simple gearing can thereby be constructed.

It may also turn out to be of advantage when the freewheel is arranged between the roll shaft and the roll and when the gear is connected to the roll shaft for rotation therewith. The gearing can thus be designed in a particularly compact manner, with the freewheel being possibly arranged outside the housing, whereby the housing can be made even more compact.

These and other features and advantages of the invention will be apparent from the figures as fully explained in the Detailed Description of the Preferred Embodiments.

BRIEF DESCRIPTION OF THE DRAWINGS

Other objects and features of the present invention and many of the attendant advantages of the present invention will be readily appreciated and become better understood by reference to the detailed description when considered in connection with the accompany drawings in which like reference numerals designate like parts throughout the figures thereof and wherein.

DETAILED DESCRIPTION OF THE PREFERRED EMBODIMENTS

Figure 1:
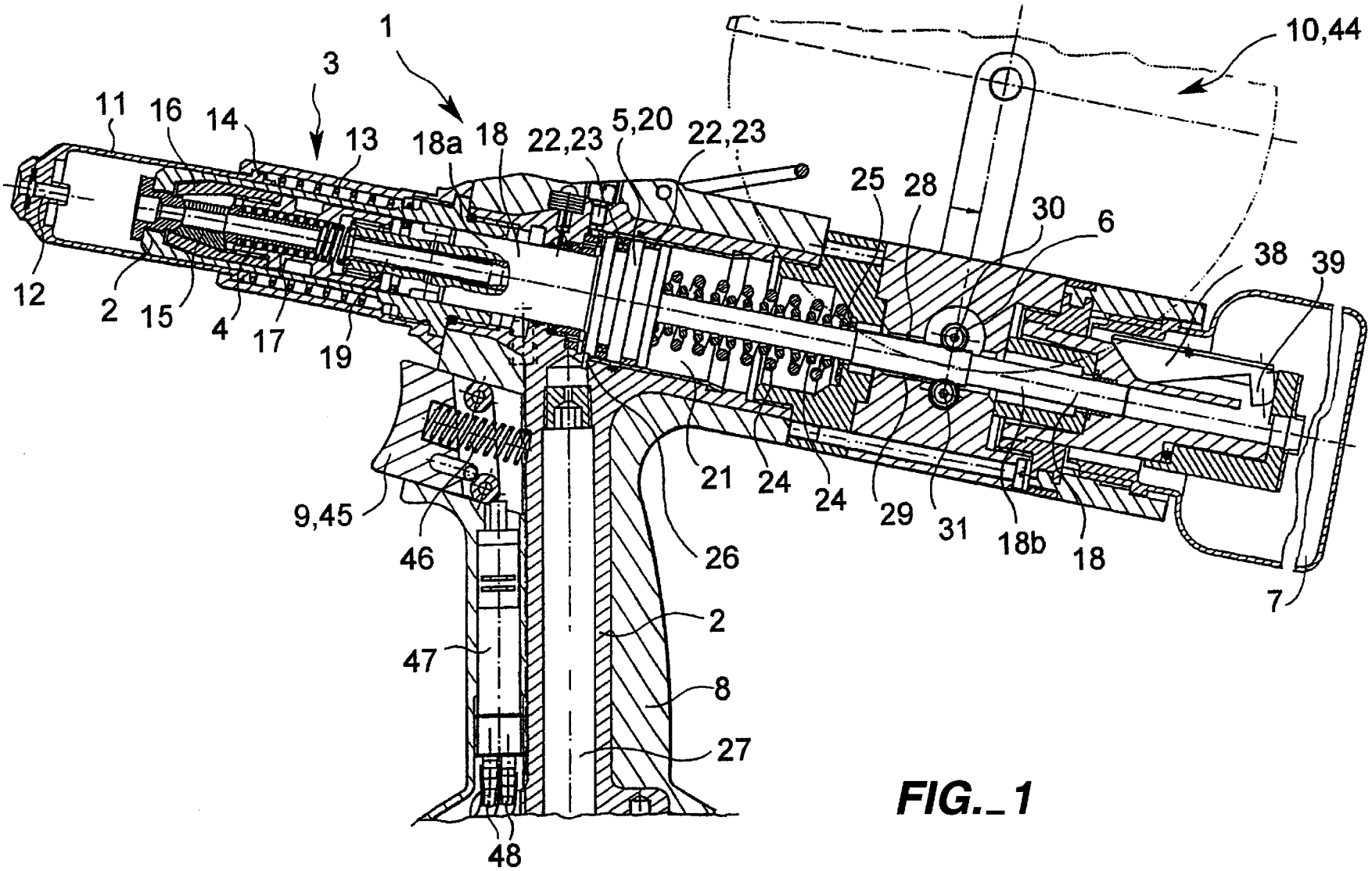
FIG. 1 is a sectional view showing the rivet setting device according to the invention.

FIG. 1 is a sectional view showing the rivet setting device 1 according to the invention. The rivet setting device mainly consists of a housing 2, a rivet setting means 3 including a pulling means 4, a piston-cylinder means 5, a gearing 6, a rivet collecting container 7, a handle 8 and an actuating means 9. The above-mentioned components are either received in or attached to the housing 2. There is additionally provided a rivet supply means (not shown in greater detail) comprising a magazine strip (also not shown in greater detail). Of the rivet supply means, there is only schematically shown in a dash-dotted line a drum which has wound thereonto a magazine strip filled with blind rivets. The supply means includes an illustrated magazine-strip pulling means 10.

The rivet setting means 3 comprises a mouthpiece 11 which includes an opening 12 for inserting the rivet mandrel of a blind rivet. The rivet mandrel is inserted in the known manner. The mouthpiece 11 is substantially sleeve-shaped and supported in the housing 2 in an axially displaceable manner. The mouthpiece 11 is supported via a spring 13 relative to the housing 2 in axial direction. Moreover, there is provided a stop 14 on which the mouthpiece is supported relative to the housing in the illustration shown in FIG. 1.

The pulling means 3 comprises three clamping jaws 15 which are displaceably received in a cone 16 of the pulling means 4, the clamping jaws being biased relative to each other by a spring 17 in the known manner. The rivet mandrel comes into engagement with the clamping jaws 15 and is held by said jaws in the known manner by inserting a blind rivet into the mouthpiece 11 and by pressing the mouthpiece against the force of the spring 13.

The pulling means 4 is an integral part of a piston rod 18 which is made tubular and comprises a passage 19 which terminates in the rivet collecting container 7. The piston rod is displaceably supported in the housing 2 in axial direction and simultaneously forms part of the piston-cylinder means 5.

Moreover, the piston-cylinder means 4 comprises a piston 20 which is made integral with a front section 18*a* of the piston rod 18 and is displaceably received in a cylinder 21. The piston 20 comprises grooves 22 which have provided therein ring seals 23 which seal the piston 20 relative to the cylinder 21. A spring means 24 is disposed concentric with the piston rod 18 and consists of two pressure springs that are concentrically arranged relative to each other and are supported in the piston 20 on the one hand and on an inner cylinder wall 25 inside the cylinder 21 on the other hand. The piston 20 is biased by the spring means 24 towards the mouthpiece 11. An air inlet 26 terminates in the cylinder 21. Air is supplied via an air supply channel 27 which is arranged in the handle, and air can pass through the air inlet 25 out of the air supply channel into the cylinder 21 and can thereby move away the piston 20 towards the mouthpiece 11 in the known manner.

Figure 2:
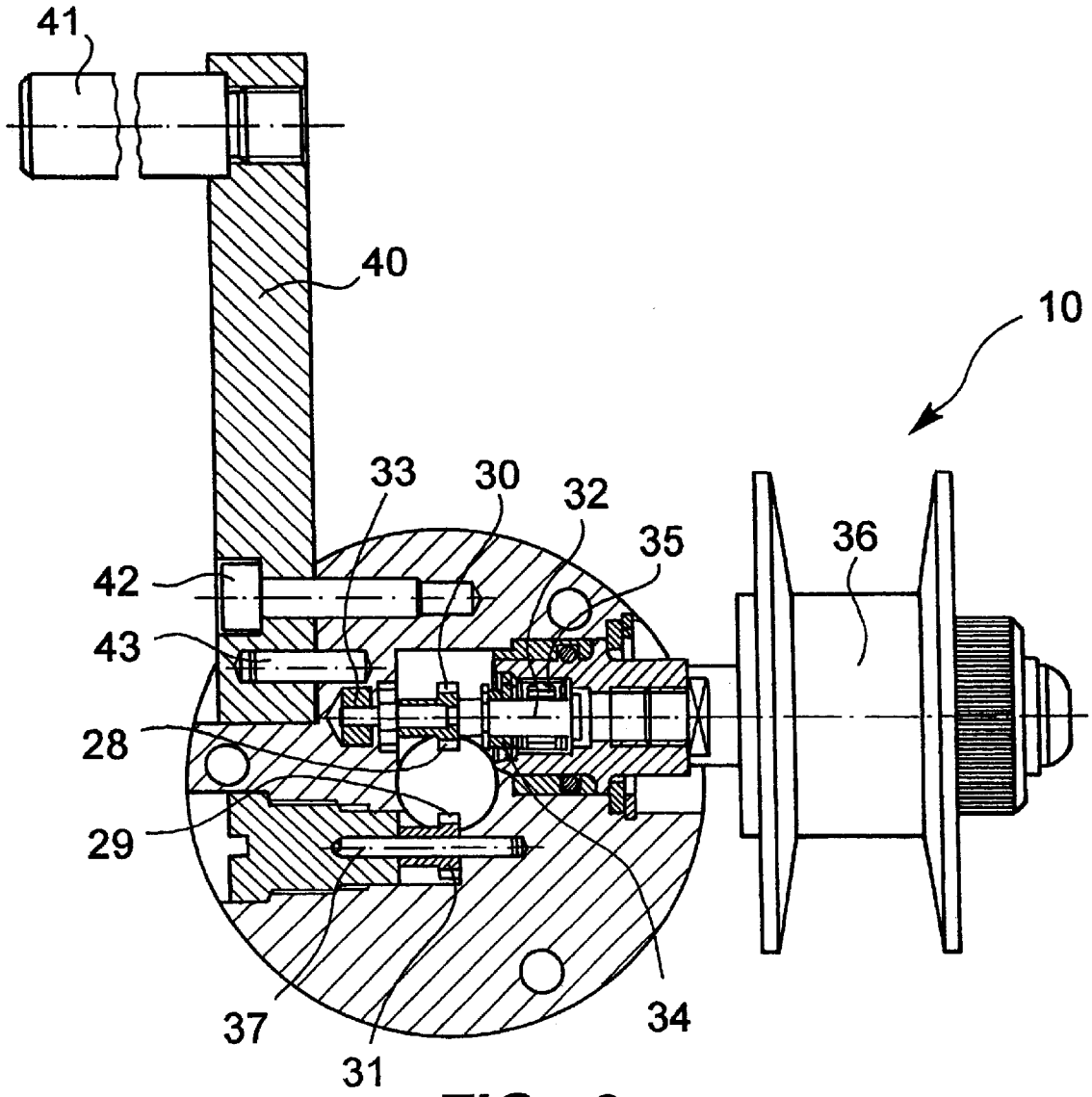
FIG. 2 is a sectional view showing the rivet setting device of FIG. 1 along line II—II in FIG. 1.

At the side of the piston-cylinder means which faces away from the mouthpiece 11, there is provided a rear section 18*b* of the piston rod 18 with two opposite rack sections 28 and 29 in which gears 30 and 31 are respectively meshing. The upper rack 28, which is shown in FIG. 2, and the associates gear 30 form part of the gearing 6. The gear 30 is connected to a roll shaft 32 for rotation therewith, the shaft being rotatably received at bearing locations 33 and 34 within the housing 2.

The roll shaft 32 has supported thereon a freewheel 35 which, in turn, supports a roll 36. A firm rotational connection between the roll shaft 32 and the roll 36 is only established by the freewheel in one rotational direction of the roll shaft 32. The freewheel is here designed such that, upon a movement of the piston 20 away from the mouthpiece, no firm rotational connection is established between the roll shaft 32 and the roll 36 and, when the piston is moved towards the mouthpiece, the roll shaft 32 and the roll 36 are connected to each other for joint rotation.

The lower gear 31 is rotatably supported on a shaft 37 within the housing and serves as a support gear for the piston rod 18.

Moreover, at the side of the gearing 6 which faces away from the mouthpiece 11, there is provided a release flap 38 which comprises an end section 39 which is movable into an out of the passage 19. The release flap 38 is pivotable about an axis which is substantially perpendicular to the longitudinal axis of the piston rod 18.

FIG. 2 additionally shows a mounting 40 with a receiving mandrel 41. The mounting 40 is firmly installed within the housing 2 by way of a screw connection 42 and a pin connection 43. The receiving mandrel 41 serves to receive the drum (shown in broken line in FIG. 1) together with the magazine strip, the drum 44 being rotatably arranged on the receiving mandrel 41.

The actuating means 9 consists of a switch 45 which is movably supported in the known manner within the handle 8 and biased by a spring 46. When being pressed into the handle 8, the switch 45 actuates a valve 47 which communicates with a source of compressed air via compressed air lines 48, which are only shown sectionwise. The exact design of the valve 47 is known from the prior art. It is also known from the prior art how the compressed air passes from valve 47 into the air supply channel 27. Compressed air is released by depressing switch 45 and thus by actuating the valve 47 and passes into the air supply channel 27 to flow from said channel into the piston-cylinder means. Moreover, a venting means (not shown) is provided to let the compressed air escape from the cylinder 21.

The operation and function of the invention shall now be explained in more detail.

To put the rivet setting device into operation, drum 44 (not shown) is first mounted on the receiving mandrel 41 and the magazine strip which is mounted on the drum and includes rivets arranged thereon is disposed in the known manner within the supply means and the end of the magazine strip is connected to the roll 36. At the beginning of the rivet setting operation, a blind rivet (not shown) is positioned within the mouthpiece 11, the rivet mandrel thereof projecting in the known manner into the mouthpiece 11 through the opening 12. When the rivet is applied to the component to be riveted, the mouthpiece is moved against the force of spring 13, with the rivet mandrel passing in the known manner between the spring (17)-based clamping jaws 15 and being retained by the clamping jaws 15.

When the operator now actuates the switch 45 in the known manner, compressed air will pass via the air inlet 26 into the cylinder 21, whereby the cylinder 21 is moved away from the mouthpiece 11 together with the piston rod 18. The pulling means 4 which is made integral with the piston rod 18 is also moved away from the mouthpiece, whereby the blind rivet is set and the rivet mandrel is torn off during the setting operation or after the completion of said operation, but while the piston is being moved away from the mouthpiece 11. When the piston is in its position farthest away from the mouthpiece 11, air is let out of the cylinder 21, with the spring means 24 pressing the piston 20 back into its initial position.

While the piston 20 is being moved from its initial position into the position of the piston 20 farthest to the right side in FIG. 1 during the performance of the rivet setting operation, the roll 36 is decoupled by the freewheel 35 from the roll shaft 32. Hence, there is no rotational movement of the roll 36 during the rivet setting operation.

During the return movement of the piston 20, however, the roll 35 is connected to the roll shaft 32 for rotation therewith, so that the roll 36 is rotating during the return movement of the piston 20. As a result, a pulling action is exerted on the magazine strip and the magazine strip is further conveyed until the next rivet mandrel is supplied to the mouthpiece 11. The length of the rack section 28 and the number of teeth of the gear 30 must be dimensioned accordingly. Thus, the magazine-strip pulling means which is formed by the gearing 6 and the roll 36 with the freewheel 35 conveys the magazine strip in order to supply the blind rivet.

The torn-off rivet mandrels pass from the clamping jaws 15, which release the rivet mandrel in the known manner after the completion of the rivet setting operation, into the passage 19 of the piston rod 19, thereby passing into the rivet collecting container 7 in which the piston rod 18 terminates. The release flap 38 is also controlled in the known manner.

Thanks to the design of the gearing 6, it is now possible to use a known magazine-strip supplying means in pneumatically or hydraulically operated rivet setting devices as well. A hydraulic rivet setting devices operates in the same way as a pneumatic one, with the hydraulic fluid being used instead of air.

With the present invention has been described in conjunction with several alternative embodiments, these embodiments are offered by way of illustration rather than by way of limitation. Those skilled in the art will be enabled by this disclosure to make various modifications and alterations to the embodiments described without departing from the spirit and scope of the present invention. Accordingly, these modifications and alterations are deemed to lie within the spirit and scope of the present invention as specified by the appended claims.

What is claimed is:

1. A rivet setting device comprising:

a rivet setting means;

a drive to actuate said rivet setting means to perform a rivet setting operation, where said drive is a pneumatic drive, a hydraulic linear drive, or any combination thereof; and a magazine-strip pulling means which comprises a roll connected to the drive, wherein the drive further includes a piston-cylinder means including a piston and a cylinder to provide a linear movement, and a gearing connecting said drive to said magazine-strip pulling means to translate said linear movement into a rotational movement of the roll.

2. The rivet setting device according to claim 1, further including a freewheel between said drive and said magazine-strip pulling means and adapted to permit said rotational movement to occur only in one direction.

3. The rivet setting device according to claim 1 or 2, characterized in that the rivet setting device comprises a mouthpiece for receiving at least one rivet and the rivet setting means comprises a pulling means, the pulling means being moved by the piston-cylinder means from a position closer to the mouthpiece into a position further away from the mouthpiece so as to perform a rivet setting operation, and the pulling means being returned after the rivet setting operation so as to perform a return movement, with the piston-cylinder means and the roll being in operative communication during the return movement.

4. The rivet setting device according to claim 1, characterized in that there is provided a blocking means which inhibits said rotational movement during a portion of the rivet setting operation.

5. The rivet setting device according to claim 1, characterized in that the roll is a winding roll for winding up the magazine strip.

6. The rivet setting device according to claim 1, characterized in that the gearing comprises a rack gear including a rack on an element selected from one of the piston-cylinder means, the pulling means, or any combination thereof, and a gear connected to the roll for meshing with said rack gear.

7. The rivet setting device according to claim 1, characterized in that the piston-cylinder means is arranged between said rivet setting means and said gearing.

8. The rivet setting device according to claim 1, characterized in that the piston-cylinder means comprises a continuous piston rod.

9. The rivet setting device according to claim 1, characterized in that the piston rod is designed as a tube for passing torn-off rivet mandrels therethrough.

10. The rivet setting device according to claim 1, characterized in that the piston rod terminates in a rivet-mandrel collecting container.

11. The rivet setting device according to claim 1, characterized in that the gearing is arranged between rivet-mandrel collecting container and piston-cylinder means.

12. The rivet setting device according to claim 1, wherein the rivet setting device comprises a mouthpiece for receiving at least one rivet and is characterized in that the piston is movable from an initial position arranged closer to the mouthpiece into a position further away from the mouthpiece for carrying out the rivet setting operation.

13. The rivet setting device according to claim 1, characterized in that the piston-cylinder means is biased by a spring means into the initial position.

14. The rivet setting device according to claim 1, wherein said cylinder has an inner wall, a front side and a back side, and is characterized in that the spring means comprises at least one pressure spring which is arranged within the cylinder of the piston-cylinder means and is supported between the inner wall at the front side and the piston.

15. The rivet setting device according to claim 6, wherein said piston-cylinder means includes a piston rod connected to said piston, wherein said rack is a first rack, further including a second rack opposite the first rack, where said second rack is arranged on the piston rod, and includes a guide gear which is rotatably supported in the housing is meshing.

16. The rivet setting device according to claim 6, further including a housing and a freewheel between said drive and said magazine-strip pulling means and adapted to permit said rotational movement to occur only in one direction, and is characterized in that the roll is supported by a roll shaft which projects into the housing and is rotatably supported therein, and the gear which is connected to the roll is connected within the housing to the roll shaft and the freewheel is arranged between roll shaft and roll and the gear is connected to the roll shaft for rotation therewith.

* * * * *